US006912448B2

(12) United States Patent
Shur

(10) Patent No.: US 6,912,448 B2
(45) Date of Patent: Jun. 28, 2005

(54) CENTRALIZED MANAGEMENT SYSTEM FOR BULK-VENDING MACHINES UTILIZING WIRELESS TELECOMMUNICATIONS TECHNOLOGY

(75) Inventor: Lindsay A. Shur, 50 Townsend Dr., Middletown, NJ (US) 07748

(73) Assignee: Lindsay A. Shur, Holmdel, NJ (US)

( * ) Notice: Subject to any disclaimer, the term of this patent is extended or adjusted under 35 U.S.C. 154(b) by 183 days.

(21) Appl. No.: 10/132,479

(22) Filed: Apr. 25, 2002

(65) Prior Publication Data

US 2003/0120383 A1 Jun. 26, 2003

Related U.S. Application Data

(60) Provisional application No. 60/343,280, filed on Dec. 21, 2001.

(51) Int. Cl.[7] ..... G07F 17/00
(52) U.S. Cl. ..... 700/236; 700/242
(58) Field of Search ..... 700/236, 242

(56) References Cited

U.S. PATENT DOCUMENTS 4,766,548 A * 8/1988 Cedrone et al. ..... 700/236
5,207,784 A * 5/1993 Schwartzendruber ..... 221/6
5,608,643 A 3/1997 Wichter et al. ..... 364/479.14
5,844,808 A * 12/1998 Konsmo et al. ..... 700/244
5,963,452 A 10/1999 Etoh et al. ..... 364/479.06
6,038,491 A 3/2000 McGarry et al. ..... 700/231
6,115,649 A * 9/2000 Sakata ..... 700/241
6,181,981 B1 1/2001 Varga et al. ..... 700/236
6,250,452 B1 6/2001 Partyka et al. ..... 194/217
6,272,395 B1 8/2001 Brodbeck ..... 700/236
6,505,095 B1 * 1/2003 Kolls ..... 700/244
6,604,086 B1 * 8/2003 Kolls ..... 705/14

* cited by examiner

*Primary Examiner*—Donald P. Walsh
*Assistant Examiner*—Michael E Butler

(57) ABSTRACT

The invention utilizes a data collection module, which can operate in conjunction with a wireless companion module to transmit information regarding a vending machine to a central location to enable management to determine the cash and inventory status of each dispensing unit within a bulk-vending machine. This enables servicing of the business to be delegated to low skilled employees who replace the canisters and return them to the centralized location for cleaning and re-stocking. The invention basically utilizes a counter which is coupled to the gear mechanism of the dispensing machine and provides a count for every coin inserted. The count is compared with programmable indicia in a microprocessor to determine when the signal is to be transmitted to the central location. In this manner, the central location can also have trained employees to repair the modules and manage the inventory business so that travel between the location of the vending machine and the central headquarters is minimized.

10 Claims, 2 Drawing Sheets

CENTRALIZED MANAGEMENT SYSTEM FOR BULK-VENDING MACHINES UTILIZING WIRELESS TELECOMMUNICATIONS TECHNOLOGY

PRIORITY FILING

This application claims priority of U.S. Provisional Application No. 60/343,280 filed on Dec. 21, 2001 and entitled, "Centralized Management System for Bulk-Vending Machines Utilizing Wireless Telecommunications Technology".

FIELD OF INVENTION

This invention relates to bulk-vending machines, and more particularly, to a centralized management system for such machines utilizing wireless telecommunications technology.

BACKGROUND OF THE INVENTION

The management of modern bulk-vending machines cannot be remotely executed via centralized communications systems. The issue arises from the fact that the machines do not record the cash collected, or the amount dispensed. Such data requires calculation from the volume of product remaining in each dispensing unit. Cash/dispensing information is critical to the centralized management of the vending business. Since remote data collection is not readily available in modem bulk-vending machines, centralized communication management systems have not been developed/patented/proposed for this business.

The present invention extends the centralized communication systems that have been developed/patented/proposed for pre-bagged/canned/bottled vending machines. Specifically, one defines a data-recording module for each dispensing unit that stores critical bulk-vending data. The data-recording module has a wireless companion module that allows the remote bulk-vending machines to communicate with a centralized management system. Such an invention allows the centralized manager to evaluate the status of a bulk-vending machine remotely. This invention allows large corporations to enter the bulk-vending business since management can remotely determine the cash that is being collected from each machine. It appears that the inability to independently monitor the cash collected from the machines has impeded large corporations from entering the bulk-vending business. This has occurred despite the fact that marginal profits on bulk products are substantially more than those on packaged goods.

For the pre-bagged/canned/bottled vending machine, the amount dispensed is fixed and the price changes according to the product and vending management decisions. For the bulk-vending machine, the price is fixed and the vending management adjusts the amount dispensed by adjusting the size of the internal dispensing compartment. The nature of these businesses is inherently different.

Modern bulk-vending machines are lightweight, manufactured from durable PVC products, and do not require the service operator to have a truck. Modular design is the trend with the bulk candy dispenser being above the coin-receiving mechanism. Machines can be pre-assembled and transported in a car, or partially assembled, transported in a small car, and then fully assembled on site. Broken modules can be repaired or replaced easily with few skills needed. No electrical hook-ups are required. The portability of the machines allows the machine to be transported to an alternate location if the current location becomes unprofitable for some reason.

The simplicity of the bulk-vending machine means that the machines are inexpensive and entry into the vending business is relatively easy. The simplicity of design also requires few skills for servicing. Maintenance of the bulk canisters and repair of machine modules can be done in a centralized location, where skills may be different and managed more efficiently. The setting of the internal compartment of each dispensing unit can be managed at the centralized location, since the dispensing unit is part of the canister removed at service. The major concern in the bulk-vending business is that the number of collected coins varies according to the dispensing unit setting within each canister. It is lengthy to determine the number of coins that should be in the coin tray at the time of service. For startups, the owner tends to collect the money preventing disputes concerning the amount of money that was in the machine. Should the owner with to delegate the servicing responsible to an employee or contractor, this issue impedes business efficiency.

In this invention, a data-recording unit with a wireless communication companion module within the bulk-vending machine is described. Such an invention allows centralized management of numerous bulk-vending machines via wireless technology communication. Communication can be initiated by the on-site bulk-vending machine or by the centralized system.

SUMMARY OF INVENTION

The invention utilizes a data collection module, which can operate in conjunction with a wireless companion module to transmit information regarding a vending machine to a central location to enable management to determine the cash and inventory status of each dispensing unit within a bulk-vending machine. This enables servicing of the business to be delegated to low skilled employees who replace the canisters and return them to the centralized location for cleaning and re-stocking. The invention basically utilizes a counter which is coupled to the gear mechanism of the dispensing machine and provides a count for every coin inserted. The count is compared with programmable indicia in a microprocessor to determine when the signal is to be transmitted to the central location. In this manner, the central location can also have trained employees to repair the modules and manage the inventory business so that travel between the location of the vending machine and the central headquarters is minimized.

DETAILED DESCRIPTION OF THE INVENTION

Figure 4:
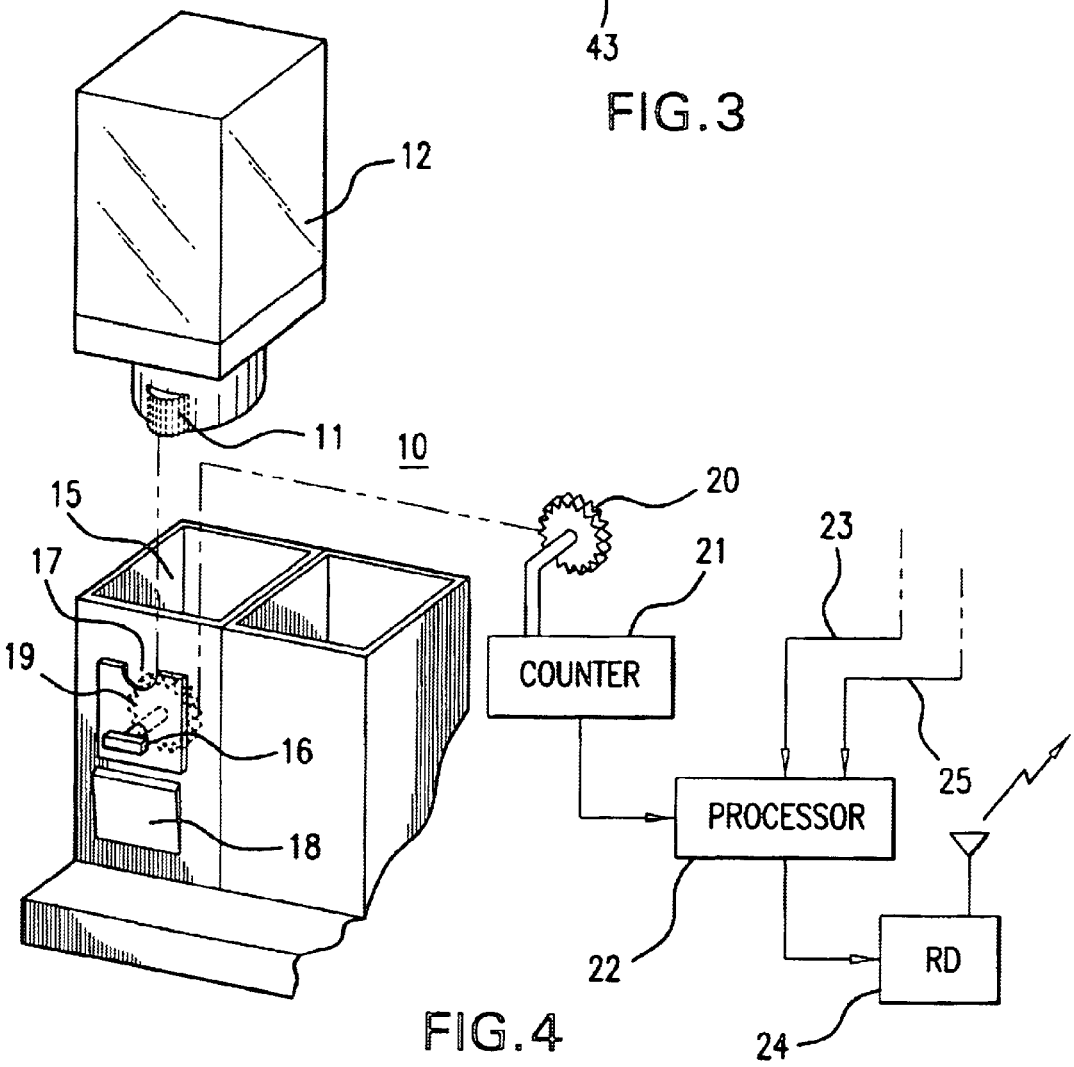
FIG. 4 is a block diagram and partly in schematic form depicting the operation of the present invention in conjunction with a vending machine.

The modem bulk-vending machine has a dispensing unit with internal compartments that are adjusted according to the product being sold. An example of such a machine in regard to a single canister is shown in FIG. 4. For example, the internal compartment setting for pistachios is about twice that of other types of candy so that the consumer feels that the dispensed amount is generous and sales are repeated. The internal compartment is the volume of candy or other items that would be dispensed when the appropriate coin is received. The coin-receiving unit of a bulk-vending machine will accept only one coin type. Certain pieces of candy, for example, occupy the same volume as multiple pieces of additional candy, as for example, small bars of chocolate compared to jelly beans. Repeated sales are the key to success in any business and receiving two pieces of candy may be seen as a "rip off" by the consumer and result in a few repeated sales. Repeated sales drives inventory turn over. Bulk-vending machines with low repeated sales have high inventory, spoilage and low profits. State of the art bulk-vending machines have multiple removable canisters, which are changed at the time of service. Product changes often result in temporary increased sales since the new items generate consumer curiosity.

Each bulk-vending canister has a separate coin-receiving mechanism. A consumer purchasing a product inserts the appropriate coin into the coin slot and returns an external dial on the coin-receiving mechanism. The external dial rotates an internal coin-receiving gear that measures into the compartment gear of the dispensing unit. The dispensing compartment gear rotates the internal compartment gear over the chute, the product falls and is retrieved by the consumer. Bulk-vending machines are inherently different from package vending machines, since mechanical simplicity and minimum maintenance are critical. Only one type of coin is accepted by the coin-receiving mechanism of a bulk-vending machine. Such bulk-vending machines are known in the art and for an example, an interchangeable canister bulk-vending machine is sold under the trademark Vendstar 3000.

Figure 1:
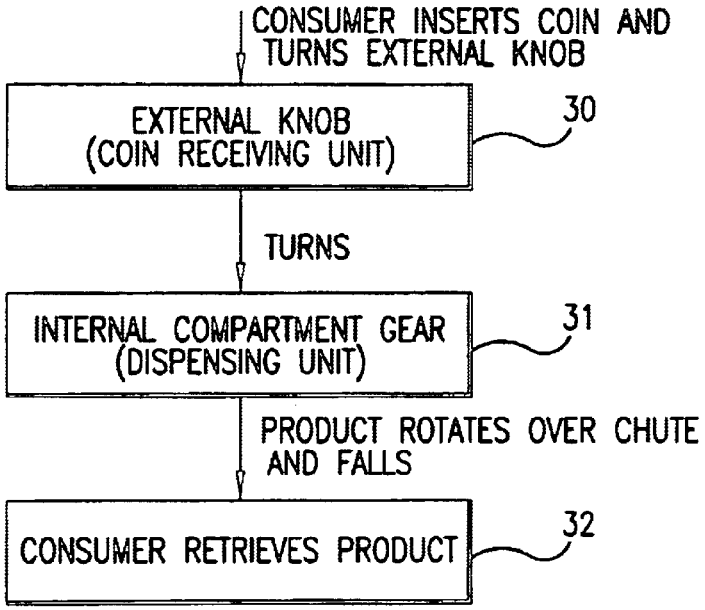
FIG. 1 (PRIOR ART)
FIG. 1 is a block diagram in flow chart format depicting the operation of a prior art vending machine.

Referring to FIG. 1, there is shown a typical flow chart of operation of a bulk-vending machine according to the prior art. A consumer inserts a coin into the machine and turns an external knob, the external knob has a coin-receiving unit depicted by module 30. The rotation of the knob, which is unlocked by the deposit of a coin, enables an internal compartment gear to operate as shown in step 31. This is a dispensing unit. The dispensing unit turns a table to an opening, rotates over the chute and falls through the dispensing slot, where the customer receives the product as indicated by reference numeral 32. This is a simple operation.

Figure 2:
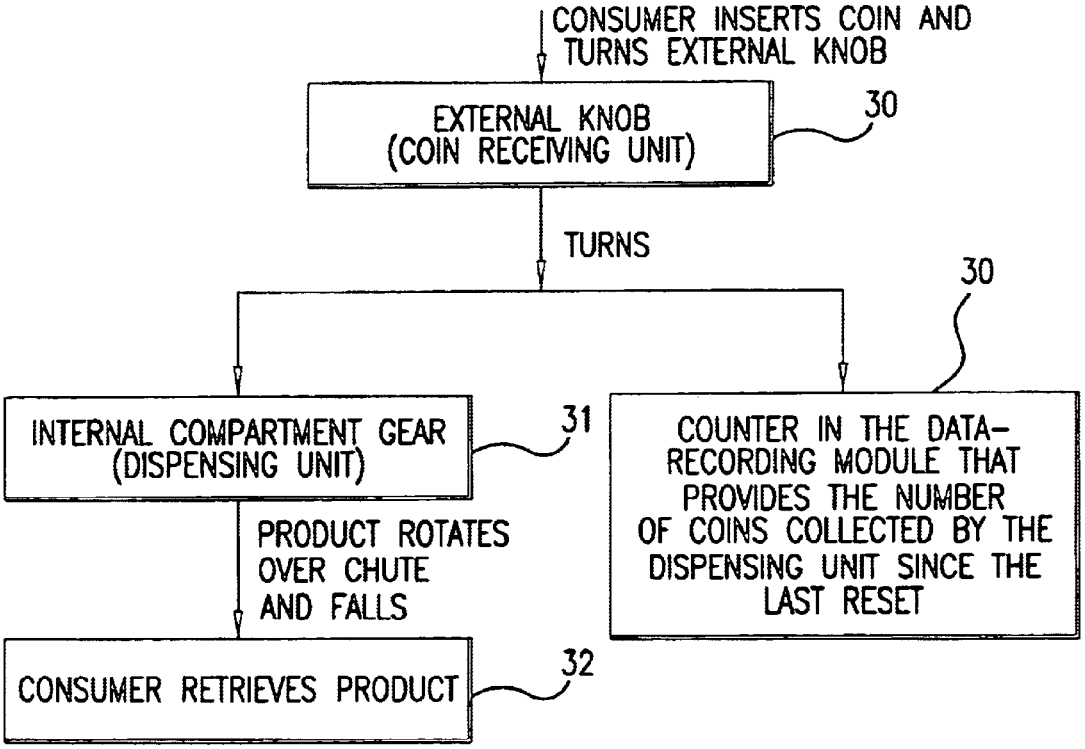
FIG. 2 is a block diagram in flow chart format depicting the operation of a vending machine according to the present invention.

Referring to FIG. 2, there is shown a simple block diagram of the present invention. It is noted that the invention operates according to the prior art in that modules 30, 31 and 32 all perform the same function. As seen, there is an additional module 33, which basically is a counter which is contained in the data recording module. The counter provides the number of coins collected by the dispensing unit since the last re-set, as will be explained in greater detail.

Figure 3:
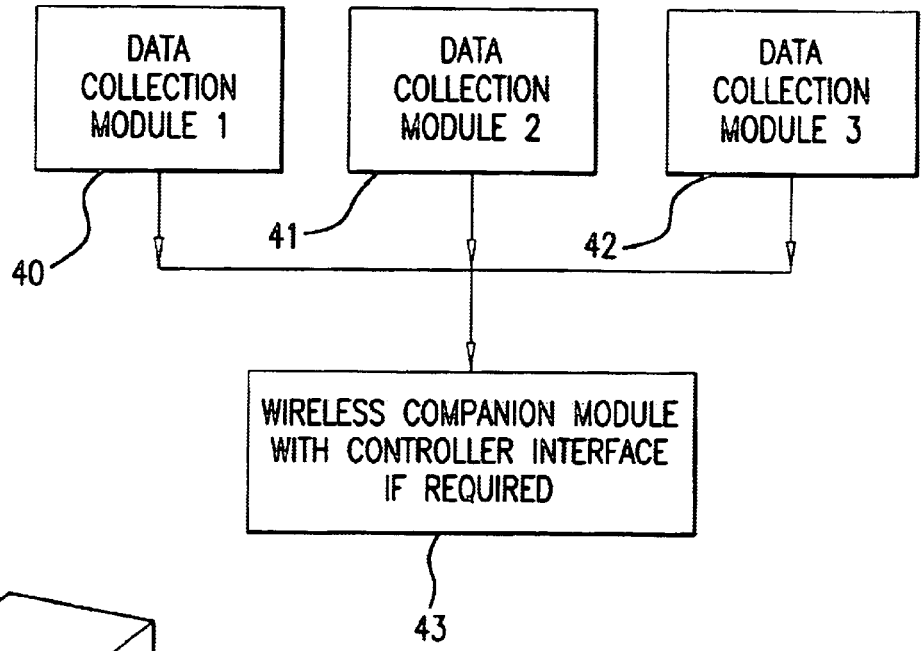
FIG. 3 is a block diagram depicting a multiple canister vending machine employing the present invention.

FIG. 3 shows that a multiple dispensing machine, which has multiple data collection modules concerned with multiple canisters as 40, 41 and 42, can all be connected to a wireless companion module 43 with a controller interface, if required, whereby the data can be transmitted through a wireless link, as will be further explained.

Essentially, and according to this invention, and as depicted briefly in regard to FIG. 2, the actual number of coins collected per dispensing unit is essential to any information that is stored or collected by the bulk-vending machine. The information and perhaps derivatives (set manually or remotely), can then be communicated to the vending management by a battery operated wireless companion module deployed within the bulk-vending machine, as will be further described.

As indicated, and is shown in FIGS. 2 and 3, the coin-receiving mechanism accepts only one type of coin. For example, the coin can be 25 cents and so on. Counting the number of coins is critical to any data collection for a bulk-vending machine. The present invention, as depicted in FIG. 2, proposes that the gear driving the internal dispensing compartment also turns a counter that records the number of coins collected since the counter was last reset. The coin-receiving mechanism is a pin module on the front of the bulk-vending below the dispensing unit. Behind the coin-receiving mechanism module is the chute which funnels the product from the back of the dispensing unit to the front of the machine for the consumer to retrieve. A few inches below the chute funnel is the coin tray, where the coins gather until the service call. This is, of course, widely understood in the prior art and the operation of bulk-vending machines is well known.

In any event, as one can ascertain, there is considerable space below the dispensing unit to attach a data collection module and a wireless module according to this invention within the machine. The wireless companion module interfaces with the data collection module and reads the counter and other information, if appropriate. It is more efficient for the wireless module to reside within just one of the coin-receiving units and have a controller to interface with the multiple data collection modules for bulk-vending machines that have multiple canisters.

As will be explained in conjunction with FIG. 4, the centralized vending machine management system comprises a computer or telephone or other wireless technology which could be deployed within the machine to determine the approximate status of the machine. The wireless companion module uniquely identifies the machine as well. The actual information communicated to and from the centralized vending management system can be very simple or complex, but such data is derived from the coins deposited. If the number of coins collected exceeds certain thresholds (there may be a function of the product deployed in the associated dispensing unit) then the wireless companion module would initiate a call to the centralized management system. The thresholds could be set locally on the machine or remotely by the centralized system depending on the implementation or the manufacture. The counting or inventory information would need to be reset at appropriate times (for example, when the items are stocked), resetting on the data collection module could mimic reset buttons found on mechanical coin copying machines, or be done electronically, which allows resetting to be done remotely.

Referring to FIG. 4 appended hereto, there is shown a bulk-vending machine 10 of the type depicted in a circular entitled, "The Unique, Interchangeable Canister" such as the machine produced by Vendstar 3000. As one can ascertain, the vending machine 10 has a canister 12, which is filled with an item to be dispensed, such as bulk candy and so on. The canister is also associated with a gear 14. When the canister is inserted into the opening 15 of the base of the machine, the gear 16 interfaces with a front knob 16. The knob 16 is positioned below a coin slot 17. A flap 18 enables a consumer to receive the dispensed product, which as shown in the circular, can be M&M's, pistachios or some other type of candy or product. The operation of such machines can be easily ascertained. The dispensing machine 10, as well as many other dispensing machines, enables a user to insert a coin into the coin slot 17 and when the coin is inserted, the user then turns the knob 16, which now meshes with the gear 14. The knob 16 turns and performs a revolution or multiple revolutions. The gear 14 is moved in a position where an opening occurs between the dispenser and a chute, which is not shown, which chute interfaces with an opening beneath the flap 18 and therefore enables a user, after insertion of the coin, to lift the flap 18 and receive the dispensed product. This operation is extremely well known and essentially has been described above.

In any event, shown in the Figure is a gear 20 which is coupled to a counter 21. The gear 20 is also coupled to the gear 14 and will cause the counter 21 to advance 1 count for each coin received by the machine. The counter 21 may be mechanical or electrical. If a mechanical counter is used, the output can be converted to an electrical signal by many well-known techniques. The output of the counter is directed to an input of a processor 22, which may, for example, be a microprocessor or any processing device. Also shown coupled to the processor 22 are two additional inputs designated as 23 and 25, which, for example, may come from the other dispensing units or canisters associated with the vending machine 10. As, for example, shown in the enclosed circular, there are three dispensing units in one machine. It is, of course, understood that there can be more than three and so on. Essentially, the processor 22 can process signals from all dispensers in each vending machine or each different unit in each machine may have its own processor and circuitry. Also coupled to the output of the processor is a remote device 24 which basically is a wireless transmitting device which can transmit a signal, as is well known, to a remote location, which would be the central management location. It is understood that a wired transmitter could be used as well, for example, over a telephone line or other transmission medium. The remote device 24 may also contain a receiver and can be operated by the central location to cause the processor to transmit the status to the vending machine based on the received command from the central location.

In summation, the device operates as follows. Upon rotation of the gear 14, which is associated with the depositing of the coin, the gear 20 interfaces with the counter to add one count for a dispensing rotation of gear 20. This would indicate that one coin has been deposited and therefore one volume of contents has been released from the machine. The processor can store this count and compare this count with a predetermined threshold count. This applies to each of the canisters. In this manner, the processor, for example, will indicate that canister 12 has dispensed 50 volumes and therefore has collected, for example, 50 coins (threshold number) and the remaining amount may constitute another ten volumes and therefore, the canister has to be refilled. When the threshold is reached the processor will activate the remote device 24 to transmit a signal to the remote location. The signal transmitted can be indicative of the need to fill the machine and may include, of course, the identity of the machine and the location of the machine, as well as many other indications so that the central location can accurately locate and monitor the machine. It is, of course, understood that there are numerous ways of implementing the remote device 24 operation, including many different modes of transmission.

In any event, each dispensing unit will have such information stored in the processor and therefore, the central management may make a decision based on the transmitted results. The decision could be to transport a new container and to also be aware of the fact that the monitored machine canister has now collected 50 coins. Therefore, the management would have an accurate idea of the amount of income derived from that particular canister at that particular location. The invention has been explained above and as seen from the Figures, it is one way of implementing the same. It would be, of course, understood to one skilled in the art that there are alternate ways of implementing the invention and a preferred embodiment is briefly shown.

What is claimed is:

1. In a vending machine for dispensing articles upon insertion of a coin in a receptacle associated with said machine and operative to dispense a product when said coin is received by said machine, in combination therewith, a counter for providing at an output count signal indicative of each coin received by said machine, a processor for storing the count signal and for comparing the count signal with a programmed condition to provide an output when said count signal equates to said condition which may also be indicative of the receipt of a given number of coins, and transmitting means coupled to said processor and responsive to said processor output to transmit a signal to a central location informing said location that said condition has been met by said vending machine, wherein said counter has an input coupled to a gear in said machine, which gear operates when a knob associated with said coin receptacle is rotated.

2. The vending machine according to claim 1 wherein said counter output is indicative of the amount of product dispensed.

3. The vending machine according to claim 1 wherein said transmitted signal includes information as to the location of said machine.

4. The vending machine according to claim 3 wherein said transmitted signal includes information related to the serial number of said machine.

5. The vending machine according to claim 1 wherein said processor is a microprocessor.

6. The vending machine according to claim 1 wherein said transmitting means is a wireless transmission.

7. The vending machine according to claim 1 wherein said transmitting means includes receiving means for remotely operating said transmitting means at said central location.

8. The vending machine according to claim 1 wherein said programmed condition is a stored threshold count indicative of a given number of received coins.

9. The vending machine according to claim 1 wherein said transmitting means are directly wired to a central location.

10. The vending machine according to claim 1, wherein said knob is normally in a locked state and when a coin of predetermined type is inserted into said coin receptacle and said knob is rotated, the presence of the coin unlocks the knob allowing it to turn and advance the counter by one count.

* * * * *